US005554091A

United States Patent [19]

Patey

[11] Patent Number: 5,554,091

[45] Date of Patent: Sep. 10, 1996

[54] METHOD AND APPARATUS FOR MINIMIZING LACTICEMIA DURING EXERCISE

[76] Inventor: Kenneth Patey, 2851 ½ County Rd. 4, Meeker, Colo. 81641

[21] Appl. No.: 459,186

[22] Filed: Jun. 1, 1995

[51] Int. Cl.[6] ..... A63B 21/02

[52] U.S. Cl. ..... 482/111; 482/121; 482/129; 4/577.1

[58] Field of Search ..... 482/55, 111, 121, 482/123, 129; 601/154, 157, 158, 160; 4/577.1, 559

[56] References Cited

U.S. PATENT DOCUMENTS

| | | | |
|---|---|---|---|
| 1,630,797 | 5/1927 | Marwick . | |
| 3,859,990 | 1/1975 | Simon | 601/157 |
| 4,109,905 | 8/1978 | Meier . | |
| 4,218,056 | 8/1980 | Whitling | 482/55 |
| 4,577,859 | 3/1986 | Gossett . | |
| 4,776,581 | 10/1988 | Shepherdson . | |
| 4,875,673 | 10/1989 | Erickson . | |
| 4,938,469 | 7/1990 | Crandell | 482/111 |
| 4,941,659 | 7/1990 | Silvestri . | |
| 5,101,521 | 4/1992 | Levien | 4/577.1 |
| 5,306,214 | 4/1994 | Bracone . | |
| 5,385,525 | 1/1995 | Davis | 482/129 |

*Primary Examiner*—Lynne A. Reichard
*Attorney, Agent, or Firm*—Thorpe, North & Western

[57] ABSTRACT

A method for exercise which minimizes formation of lactic acid within a joint or muscle. The method comprises the steps of a) submerging the muscle or joint in a hot tub; b) positioning an elastic band between the muscle or joint and an anchor mounted to the hot tub; c) applying a jet of heated water against the muscle or joint; and d) exercising the muscle or joint by extending the elastic band while maintaining the application of the jet of heated water on the muscle or joint being exercised.

20 Claims, 1 Drawing Sheet

METHOD AND APPARATUS FOR MINIMIZING LACTICEMIA DURING EXERCISE

BACKGROUND OF THE INVENTION

1. Field of the Invention

The present invention relates to exercise methods, and particularly to methods of reducing accumulation of lactic acid within an exercised muscle or joint, with attendant pain and stiffness.

2. Prior Art

An ever increasing preoccupation with physical fitness is generating continuous growth of the fitness industry and a steadily expanding variety of exercise methods and equipment. Such exercise methods and devices now provide focused development of each particular muscle group in both static and dynamic applications and all ranges of stress and resistance, from simple toning of muscle tissue to full body building objectives.

With respect to all of the various exercise forms, there is a general perception that muscular pain and stiffness are a natural and inherent aspect of exercise. The familiar adage, "No pain, no gain" suggests the tendency to measure the quality of a fitness program by the extent of pain which results. Although some muscle stiffness and pain are a necessary part of conditioning the body, the severity can be greatly reduced by dealing with the specific physiological aspects of exercise.

A muscle fiber, for example, contains two proteins, actin and myosin. These are present as threadlike structures. When these proteins combine to form actomyosin, the fiber is shortened or contracted to provide the primary muscle force response. The energy required for this chemical reaction is obtained from the conversion of adenosine triphosphate (ATP) to adenosine diphosphate (ADP). A nerve impulse arriving at a motor end-plate causes release of acetylchlorine, which initiates this conversion. A rapid breakdown of high-energy ATP into ADP and phosphorus results. The ADP must subsequently be converted back to the ATP to enable the cycle to continue.

The necessary energy is ultimately derived from the combustion of glucose with oxygen to form carbon dioxide. When oxygen is not immediately available in sufficient quantity, such as occurs in severe muscular exertion, a certain amount of energy is temporarily obtained from the conversion of glucose to lactic acid. This is enabled because the reaction does not require oxygen. Unfortunately, the accumulation of lactic acid in the muscle tissue causes it to tire more quickly, leading to termination of the exercise activity. Therefore, the energy derived from conversion of glucose to lactic acid is temporary, at best.

Some medical studies suggest, however, that lactic acidosis offers some benefit to a training program, provided certain physiological training factors are considered. For example, patients with certain lung diseases may experience improved training response with higher levels of blood lactate than where work rates elicit only low lactate levels. It is possible that lactic acidosis serves to facilitate oxyhemoglobin dissociation and $O_2$ transport to the muscle cells. Obviously, these considerations may be interrelated. In summary, there are clearly opposing aspects of lactic acidosis which suggest both favorable and unfavorable effects, particularly where exercise programs are concerned.

From a layman point of view, lacticemia may simply be considered to be a build up of lactic acid in muscles and joints. This occurs when inadequate supplies of oxygen exist within the exercised tissue. The accumulation of lactic acid may result in pain, discomfort and muscle cramps. Obviously, the greater the stress and duration of exercise, the greater the likelihood of lacticemia.

Current methods of countering the effects of lactic acid include focusing on diet, massage and rest. A cool down period following exercise is the most common and probably the most effective prior art technique for reducing such post-exercise pain. This allows blood flow to sweep some of the accumulated lactic acid from the exerted area. Massage mechanically forces improved circulation and is very helpful in reducing pain and stiffness. Specialized diets can also assist in minimizing lactic acid formation.

Some exercise methods have been developed and encouraged as a means to minimize impact stress, such as is typically associated with exercise. U.S. Pat. Nos. 1,630,797; 4,109,905 and 4,577,859 teach improved in-place swimming methods to enable swimming in confined tanks or pools of limited dimension. U.S. Pat. Nos. 4,776,581; 4,875,673; 4,941,659; and 5,306,217 disclose other forms of aquatic exercise devices and methods that offer reduced stress. None of these patents, however, teach the need or suggest a solution for direct control of lacticemia.

What is needed, therefore, is an improved method of exercise that reduces the occurrence of lacticemia and thereby one of the primary causal factors of post-exercise pain and stiffness.

OBJECTS AND SUMMARY OF THE INVENTION

Accordingly, it is an object of the present invention to provide a method of exercise which minimizes the accumulation of lactic acid in tissue as it is exercised, thereby reducing post-exercise lacticemia.

A further object of this invention is to provide a method of exercise which allows a muscle or joint to be conditioned, yet enhances circulation at the muscle or joint to reduce lacticemia.

Yet another object of this invention is to facilitate aggressive exercise of a muscle or joint, yet enhance the enjoyment of the experience by providing a more pleasant exercise environment.

A still further object of the present invention is to provide an exercise environment which permits massage of the exercised part of the body, at the same time the muscle or joint is being exercised.

Another object of this invention is to provide a variety of methods and devices for enabling such favorable exercise activity as identified in the above recited objects.

A further specific object of this invention is to provide a method for underwater exercise which offers convenient adjustment of location of exercise devices within a hot tub.

Other objects and features of the present invention will be apparent based on the following detailed description, taken in combination with the accompanying drawings.

DETAILED DESCRIPTION OF THE INVENTION

The present invention adopts a fresh approach to the problems of lacticemia and resulting exercise pain and discomfort. Instead of offering post-exercise cool down, massage and related therapy, the present inventor has observed that a reduction in formation and accumulation of lactic acid occurs when hydro-therapy is applied to a muscle or joint during work or exercise. In other words, by exercising within a hot tub, with direct application of a jet of heated water on the muscle or joint, lacticemia is greatly reduced. Consequently, an individual is able to enjoy the benefit of rigorous exercise, within the comfort of a hot tub, while avoiding the pain and discomfort usually associated with such exercise.

Figure 1:
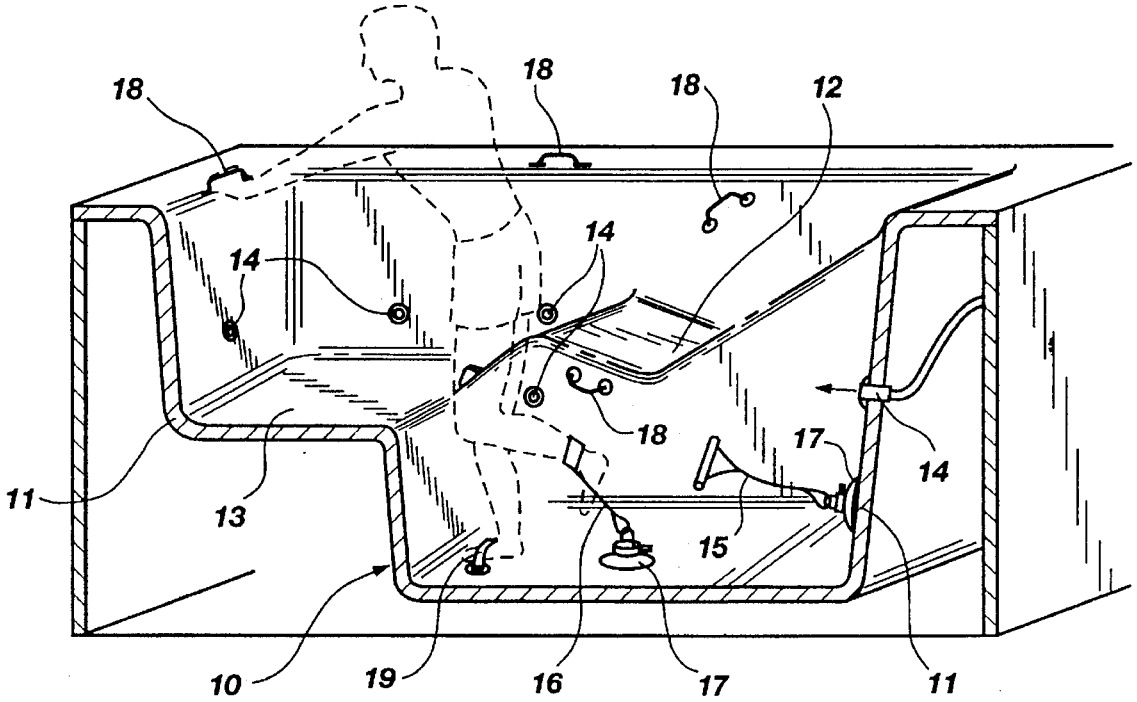
FIG. 1 shows a cross sectional view of a hot tub modified and configured for practice of the present invention.

FIG. 1 depicts a variety of exercise configurations which can be implemented within a hot tub or similar water environment. These are characterized by a general method for exercise which minimizes formation of lactic acid within a joint or muscle comprises the steps of:

a) submerging the muscle or joint in a hot tub;

b) positioning an elastic band between the muscle or joint and an anchor mounted to the hot tub;

c) applying a jet of heated water against the muscle or joint; and d) exercising the muscle or joint by extending the elastic band while maintaining the application of the jet of heated water on the muscle or joint being exercised.

A hot tub 10 provides the advantages of being capable of applying hydro-massage on each part of the body. Typical construction includes a containment wall 11 which may be structured with an inclined lounge section 12, as well as seat configurations 13 of considerable variety. The containment wall not only holds the water, but also includes and supports several hydro-jets 14 for directing hot water, and air if desired, toward a selected part of the body.

Figure 2:
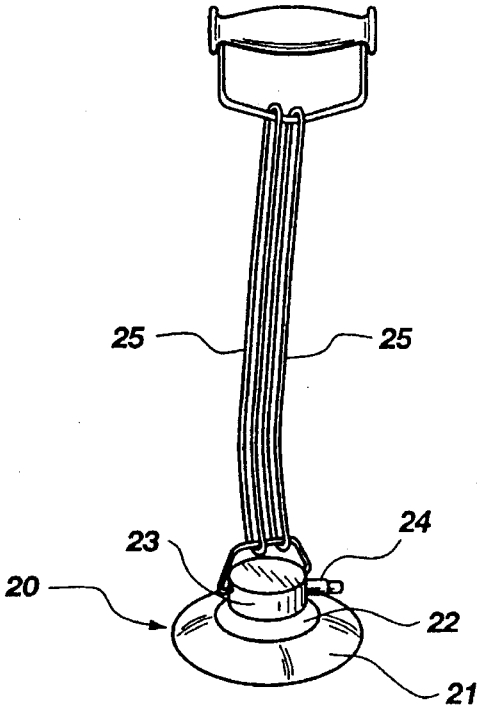
FIG. 2 illustrates a side, plane view of an attachment device for securing isometric elastic bands for use under water as part of an exercise device.

Muscle and joint exercises are enabled by attachment of elastic bands 15 and 16 at the containment wall. Although mounting plates which penetrate the wall may be used, suction anchors 17 or 20 are more beneficial because they avoid formation of holes within the containment wall structure. Such a suction anchor is shown in FIG. 2. It includes a suction pad 21, a mounting section 22 and a cylinder 23 and plunger 24 for developing the required suction to strongly retain the anchor in place, despite the substantial loads that can be imposed on such anchors during weight lifting activity. Proper placement merely involves applying the suction pad 21 against a smooth wall or floor surface and pressing into sealing contact. The plunger is then depressed several times to evacuate air from under the suction pad. It has been discovered that such a device works remarkably well under water and is able to withstand hundreds of pounds of force during exercise activities. Such suction pads are commercially available and have been used to support glass panels and other heavy objects; however, the present inventor is unaware of any application of such devices under water.

The removable suction anchors enable movement of the elastic bands to any desired location within the hot tub. For example, the anchor can be positioned at a floor location to enable exercises such as upright rowing, arm curls, leg extensions, standing squats, shoulder lateral raise exercises, as well as other exercises which facilitate a force resistance against upward motion. It may also be located on a low, side wall position for seated rowing exercise, leg kick movements, or on a higher side wall location for bench press, butterfly exercises and similar activities for upper chest development.

A variety of exercise resistance bands 25 may be selected to enable any of these various exercise programs. It has been found that elastic bands which provide isometric exercise are well suited to this methodology. The elastic character of the bands is compatible with the water environment of the hot tub. The absence of metal springs avoids rust and damage to the hot tub. The commercial availability of a full range of bands sizes and compositions enables a selection of tension resistance, as well as variety in lengths and configurations. Combinations of bands may be adopted to further extend to the variety of tension or resistance options.

Handles 18 are provided to enable an individual to hold his position during exercise. The suction anchors may also be used to provide a stabilizing support handle at appropriate locations within the hot tub. Obviously, many exercises involve pulling and pushing movement. Without some means of anchoring the body in the water, such movements would be difficult. Support handles may be applied on the floor of the hot tub, with loops or stirrups 19 for receiving one or both feet of the user. This enables the user to restrain himself in a desired position against the resistance forces applied by the elastic bands.

Similarly, support handles may be removable applied to other locations to enable use of the hands or other parts of the body for leverage and stability. This structure enables implementation of a method wherein the step of exercising includes the step of positioning a portion of the body against a stabilizing handle within the hot tub at a position which enables a person to apply a resistance against a pulling force applied to the person during exercise and thereby maintain a fixed position within the hot tub. The combined use of elastic bands at differing positions of the hot tub and properly located support handles enables exercise of multiple body parts in both seated and reclining position, while maintaining hydro-massage of the area being exercised.

Most hot tubs include a variety of water jets positioned at appropriate locations for hydro-massage. A specific array of jets may be designed and located so as to better focus hydro massage therapy on a specific set of muscles to be subject to extensive exercise. For example, jet clusters may be oriented toward the thighs, biceps and triceps which are typically muscle groups of particular interest in weight training development. By subjecting these muscle groups to hydro-massage concurrent with the exercise activity, the formation and accumulation of lactic acid can be minimized. This enables the development of these muscle groups without the traditional experience of stiffness and pain associated with a heavy workout. Air may also be introduced with the heated water to form a hydro-air massage stream.

It will be apparent to those skilled in the art that variations to the disclosed methods and apparatus are envisioned. Accordingly, it is to be understood that the foregoing disclosure is not meant to be limiting, except in accordance with the following claims.

I claim:

1. A method for exercise while submerged in a tub of water which minimizes formation of lactic acid within a joint or muscle; said method comprising the steps of:

a) submerging the muscle or joint in a hot tub;

b) positioning an elastic band between the muscle or joint and an anchor mounted to the hot tub;

c) applying a submerged jet of heated water against the muscle or joint; and d) exercising the muscle or joint by extending the elastic band while maintaining the application of the jet of heated water on the muscle or joint being exercised.

2. A method as defined in claim 1, wherein the step of applying a jet of heated water includes the step of introducing air in the jet of heated water to form a hydro-air massage stream.

3. A method as defined in claim 1, wherein the step of exercising includes the step of positioning a portion of the body against a stabilizing handle within the hot tub at a position which enables a person to apply a resistance against a pulling force applied to the person during exercise and thereby maintain a fixed position within the hot tub.

4. A method as defined in claim 3, wherein the step of exercising includes the step of mounting a support member to a containing wall and applying an isometric force at the support member and with respect to the muscle or joint.

5. A method as defined in claim 1, wherein step d) comprises exercising the muscle or joint isometrically with respect to the elastic band.

6. A method as defined in claim 1, wherein step b) further comprises the step of positioning a removable suction anchor in fixed position at a submerged section of a containment wall of the hot tub and attaching an elastic band to the suction anchor.

7. A method as defined in claim 3, further comprising the step of positioning a removable suction anchor in fixed position at a submerged section of a containment wall of the hot tub for use as the stabilizing handle.

8. A method as defined in claim 1, comprising the additional step of attaching multiple elastic bands of differing sizes to facilitate exercise of multiple body parts at differing levels of resistance with respect to the elastic bands.

9. A method as defined in claim 1, further comprising the step of positioning multiple elastic bands at differing positions of the hot tub to enable exercise of multiple body parts in both seated and reclining position, while maintaining hydro massage of the area being exercised.

10. A method for exercise which minimizes formation of lactic acid within a joint or muscle, said method comprising the steps of:

a) submerging the muscle or joint in a hot tub;

b) applying a submerged hydro-massage jet of heated water against the muscle or joint;

c) positioning an elastic band between the muscle or joint and an anchor mounted to an interior, submerged surface of a containing wall of the hot tub;

d) exercising the muscle or joint isometrically by extending the elastic band, while maintaining the application of the jet of heated water;

e) releasing tension on the elastic band to relax the muscle or joint while maintaining the application of the jet of heated water; and f) repeating steps d) and e) to strengthen the muscle or joint while reducing formation of lactic acid.

11. A method as defined in claim 10, wherein the step of applying a jet of heated water includes the step of introducing air in the jet of heated water to form a hydro-air massage stream.

12. A method as defined in claim 10, wherein the step of exercising includes the step of positioning a portion of the body against a stabilizing handle within the hot tub at a position which enables a person to apply a resistance against a pulling force applied to the person during exercise and thereby maintain a fixed position within the hot tub.

13. A method as defined in claim 10, further comprising the step of positioning multiple elastic bands at differing positions of the hot tub to enable exercise of multiple body parts in both seated and reclining position, while maintaining hydro massage of the area being exercised.

14. An apparatus for exercise which minimizes formation of lactic acid within a joint or muscle; said apparatus comprising:

a hot tub including a containing wall for water within the hot tub;

a plurality of water jets mounted within the containing wall at a position which is submerged when the hot tub is full of water;

at least one elastic band having sufficient size and strength for use to exercise and strengthen a muscle or joint and being attached to the containing wall and oriented such that a person sitting within the hot tub may apply a force against resistance offered by the elastic band; and attachment means at an end of the elastic band for attachment to the person sitting within the hot tub;

at least one of said water jets being positioned with respect to the at least one elastic band to enable the person to exercise a muscle or joint while maintaining the muscle or joint in a massaging stream of hot water ejected from at least one of the water jets.

15. An apparatus as defined in claim 14, further comprising air injection means for introducing air in the jet of heated water to form a hydro-air massage stream.

16. An apparatus as defined in claim 14, further comprising a stabilizing handle attached to the containing wall within the hot tub at a position which enables a person to apply a resistance against a pulling force applied to the person during exercise and thereby maintain a fixed position within the hot tub.

17. An apparatus as defined in claim 14, further comprising a removable suction anchor capable of being fixed at a submerged section of containing wall of the hot tub and including means for attaching an elastic band to the suction anchor.

18. An apparatus as defined in claim 14, further comprising a removable suction anchor capable of being positioned at a submerged section of the containing wall of the hot tub for use as the stabilizing handle.

19. An apparatus as defined in claim 14, further comprising anchor means for positioning multiple elastic bands at differing positions of the hot tub to enable exercise of multiple body parts in both seated and reclining position, while maintaining hydro massage of the area being exercised.

20. A method of exercise within a water environment, comprising the following steps:

a) securing a suction pad in a submerged condition to a containing wall within a hot tub;

b) reducing air content between the wall and suction pad to develop a partial vacuum;

c) attaching an elastic band to the submerged suction pad;

d) applying a force to extend the elastic band under water as part of an exercise format;

e) repeating step "c)" as part of an exercise regime.

* * * * *